US006216901B1

(12) United States Patent
Lento

(10) Patent No.: US 6,216,901 B1
(45) **Date of Patent: *Apr. 17, 2001**

(54) PACKAGE DISPENSER

(76) Inventor: Lou Lento, 4817 Courageous La., Carlsbad, CA (US) 92008

( * ) Notice: Subject to any disclaimer, the term of this patent is extended or adjusted under 35 U.S.C. 154(b) by 0 days.

This patent is subject to a terminal disclaimer.

(21) Appl. No.: 09/545,134

(22) Filed: Apr. 7, 2000

Related U.S. Application Data

(62) Division of application No. 09/096,040, filed on Jun. 11, 1998, now Pat. No. 6,085,908.

(51) Int. Cl.[7] ..... A47G 19/00
(52) U.S. Cl. ..... 220/23.4; 206/581
(58) Field of Search ..... 206/235, 581, 206/823, 216; 220/4.27, 23.4, 23.83, 23.87, 23.88, 23.89

(56) References Cited

U.S. PATENT DOCUMENTS 1,609,403 * 12/1926 Danek ..... 220/23.88
4,139,114 * 2/1979 Long et al. ..... 220/4.27
5,046,635 * 9/1991 Haas et al. ..... 220/23.88
5,115,916 * 5/1992 Beasley et al. ..... 220/23.4
5,316,159 * 5/1994 Douglas et al. ..... 220/23.4
5,356,040 * 10/1994 Reggiani ..... 220/23.4
5,381,916 * 1/1995 Strawder ..... 220/23.4
5,417,338 * 5/1995 Roy et al. ..... 220/23.4
5,735,422 * 4/1998 Binter ..... 220/4.27
5,823,391 * 10/1998 Klauke et al. ..... 220/23.4

* cited by examiner

*Primary Examiner*—Jim Foster
(74) *Attorney, Agent, or Firm*—Graham, Curtin & Sheridan; Richsrd T. Laughlin, Esq.

(57) ABSTRACT

According to the present invention, a holder is provided comprising three individual units adapted to contain materials which are related. The units are locked together with a permanent top. The individual units are proportioned to each occupy one-third of the package. Each unit can have a top or access port, such as a screw top, which form in combination a cylindrical configuration.

5 Claims, 3 Drawing Sheets

PACKAGE DISPENSER

This Application is a Division of Ser. No. 09/096,040 filed Jun. 11, 1998, now U.S. Pat. No. 6,085,908.

The invention generally relates to a merchandising package and, in particular, to such a package containing two or more interlocking units which allows for independent dispensing of a variety of solid and liquid products.

BACKGROUND OF THE INVENTION

The sale of merchandise, and particularly higher priced merchandise, requires original type packaging to distinguish it from competitive products. The standard type of unit is a rack for holding several items where the containers fit side-by-side in the rack. Typical of such dispensers are those for fingernail polish where a selection of colors is desired. It is desirable to have two or more units combined in a single package because it promotes the sale of multiple units.

OBJECTS OF THE INVENTION

One of the objects of the present invention is to provide a high-styled, sculpted type of merchandising package.

Another object of the present invention is to provide such a package which allows the grouping of items together in an interlocking arrangement.

Another object of the invention is to provide such a package which allows for replacement of the individual units when a particular item to be dispensed is exhausted.

Other objects and the advantages of the invention will be apparent from the following description.

SUMMARY OF THE INVENTION

According to the present invention, a high-styled mechanized package is provided to allow a grouping of items for the same intended use in one all-encompassing package with the separate units interlocked together to form a single unit. The package is preferably in the form of a unitary cylinder which is compartmentalized into a series of individual units, although in place of the cylinder a cube or rectangular configuration can be utilized. Each unit is interconnected to the adjacent units so that the final combination cannot fall apart or be accidentally dismantled. A typical suitable arrangement is a tongue and groove configuration. The tongue is affixed to one unit and moves in a groove provided in the adjacent unit. One end of the groove provides a locking arrangement for the tongue. By twisting the individual unit, it is placed in the secure or locked position. The locking device is preferably at one end of the groove. When a unit is rotated in the opposite direction, it is released for ease of dispensing of the contents individually.

The invention provides a high-styled, sculpted type of merchandise package exclusively designed to allow a grouping of items for the same or different intended uses to become one all-encompassing package of the necessary items to perform the functions. The package shell is designed so that each of the individual items may be repurchased as refills as needed and fitted into the original designed package. Typical examples of related goods are fingernail grooming products, eyeliners, lipsticks, blushes, brush and base. The size of the package is determined by the particular goods it is meant to accommodate.

A typical unit contains three dispensers in a pie-shaped configuration which, in the locked position, forms a cylindrical container consisting of the three dispensers. With a three-unit dispenser, the individual units are proportioned to each occupy one-third of the total package. Each unit has a top or access port, such as a screw top, which can have an applicator brush, spray device or similar dispenser. When the permanent top is removed, the individual unit is released for use. The top or cap can be configured so that the unit forms a smooth cylindrical configuration, or the tops can be configured to form a smaller cylindrical unit which sits on top of the larger base. Individual dispenser units can be replaced separately with refills, creating a marketing package that has continual use.

It is preferred to construct the outer surface of a die cast unit such as plastic. A suitable plastic would be that sold under the name Plexiglass®, or it could be formed of polyvinyl chloride or the like. The containers can also be made of metal, such as aluminum. The dispensers can be bottles or similar containers made of glass or plastic and can be tinted in coloration to add to their decorative appearance or identity of content. As an illustration, if the containers contained perfume, one could be white, the second peach and the third black.

The size of the unit will depend upon the material to be dispensed. The invention has been described in relation to the preferred embodiment of a cylindrical package, but, as indicated, other shapes can be utilized without departing from the spirit and scope of the invention.

The novel features which are believed to be characteristics of the invention, both as to its organization and method of operation, together with further objects and advantages thereof, will be better understood from the following descriptions in connection with the accompanying drawings, in which the presently preferred embodiments of the invention are illustrated by way of examples. It is expressly understood, however, that the drawings are for purposes of illustration and description only and are not intended as a definition of the limits of the invention.

DESCRIPTION OF THE PREFERRED EMBODIMENT

10 is a container.

12 is a top cover.

14 is a base.

15, 16, 17 are dispensers forming the base.

18, 19, 20 are tops for dispensers.

18', 19', 20' are screw tops.

23 is cylinder top formed when three caps are placed together.

21 is a conventional nozzle or threaded top.

24 is a groove.

26 is a short leg of the "L" extending to the side of the dispenser.

28 is a stop position at the end of the longer leg of the "L".

30 is a tongue affixed to an adjacent cap.

50 is a tongue.

52 is a corresponding recess.

40 is a ball.

42 is a corresponding recess.

60 is a spring-loaded surface.

61 is a flat metal spring steel disc.

62 is generally a container.

63 is a base.

64, 65 are two vertical sides of the base.

66, 67 ends of the base.

68 is a keyway.

69 is a key.

70 is a slot keyway in the dispensers.

71, 72, 73 are dispensers.

74 is a projection.

75 is a hole in a dispenser.

76 is a slidable knob.

77 is a projection on the slidable knob.

78 is a spring.

79, 79' are locking tabs.

Figure 2:
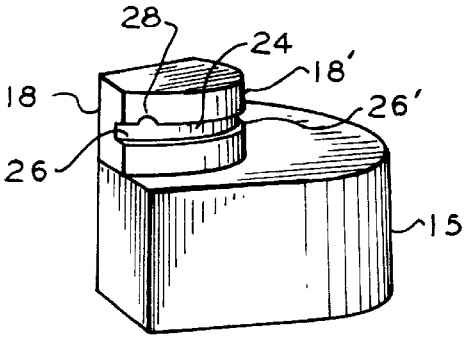
FIG. 2 is a perspective view showing one of the dispensers.
Figure 1:
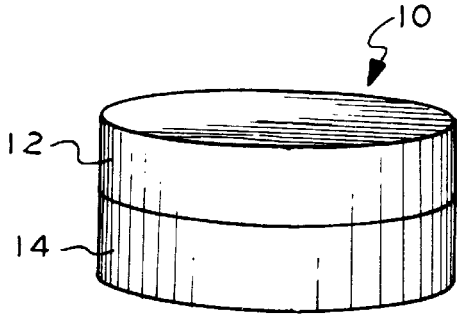
FIG. 1 is a perspective view of a container made in accordance with the invention.
Figure 3:
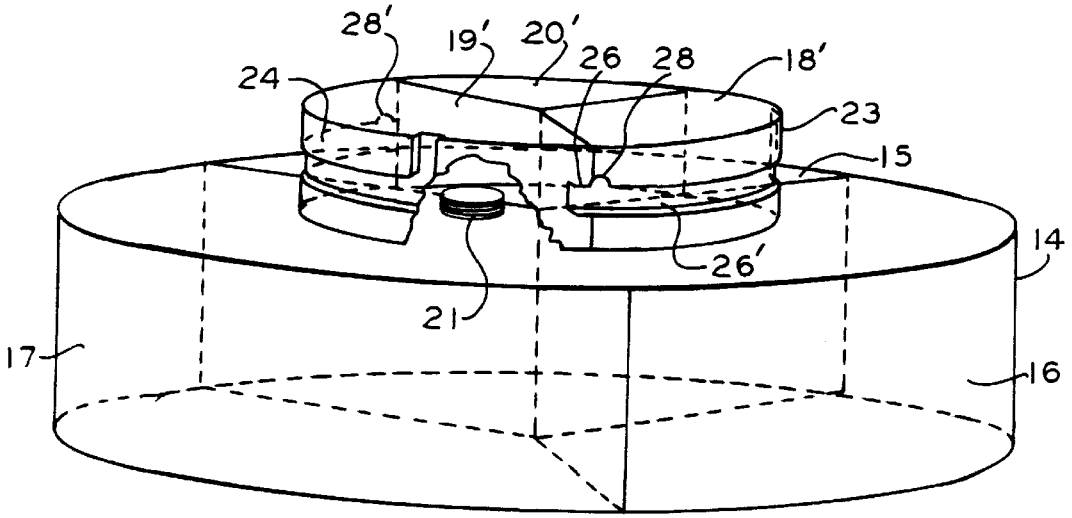
FIG. 3 is a side elevation, partly in section, showing the dispensers in the container.
Figure 4:
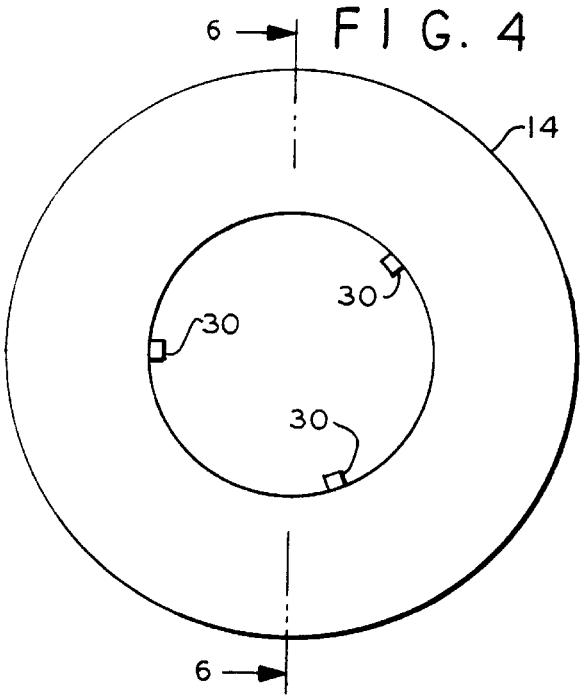
FIG. 4 is a top elevation showing the three tongues corresponding to three dispensers.

As shown in FIGS. 1 and 2, a container is generally indicated at 10 which has a top cover 12 and a base 14. The base 14 is formed of three dispensers 15, 16 and 17 which have tops 18, 19, 20 which can be removed for dispensing the contents. The tops can be screw caps 18', 19', 20'. The configuration of the screw caps 18', 19', 20' is such that they have a shape so that when the three caps are placed together in the closed position they form a cylinder top 23. The screw caps close a conventional nozzle or threaded top 21 as illustrated for one of the dispensers 17. The three caps are preferably of a smaller diameter than the base so that, when assembled, the configuration is of a smaller cylindrical structure on top of a larger cylindrical structure as illustrated in FIG. 3.

As shown in FIGS. 4 to 7, a groove 24 is formed in each of the dispensers in an "L" configuration, with the shorter leg 26 extending to the side of the dispenser and a stop or release position 28 at the end of the longer leg 26' of the "L." This construction allows the dispenser to rotate, so the tongue 30 affixed to the adjacent cap moves along the groove and the top cover 12 can be lifted off when the tongue passes out of the stop position 28 of the "L."

Figure 6:
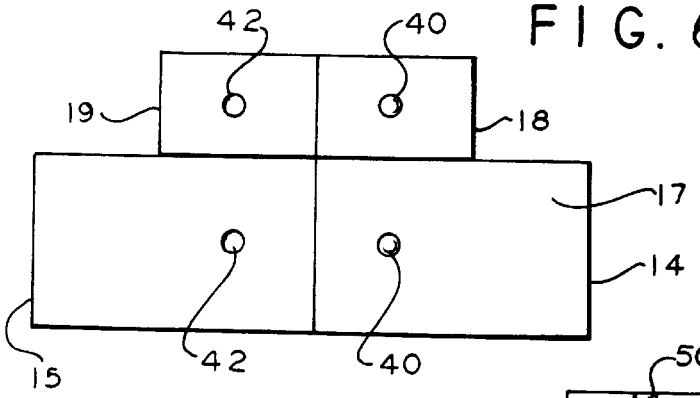
FIG. 6 is a side elevation showing the tongues and recesses for corresponding tongues.
Figure 7:
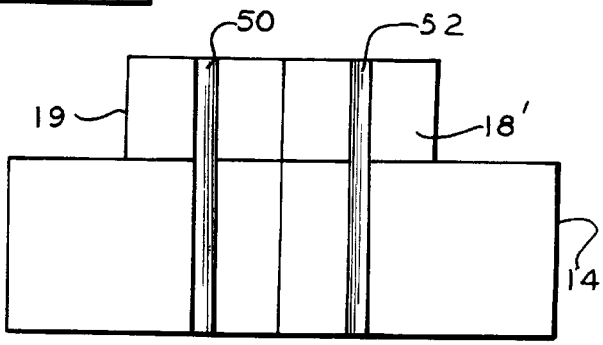
FIG. 7 is a side elevation showing the use of vertical tongues and groves.
Figure 8:
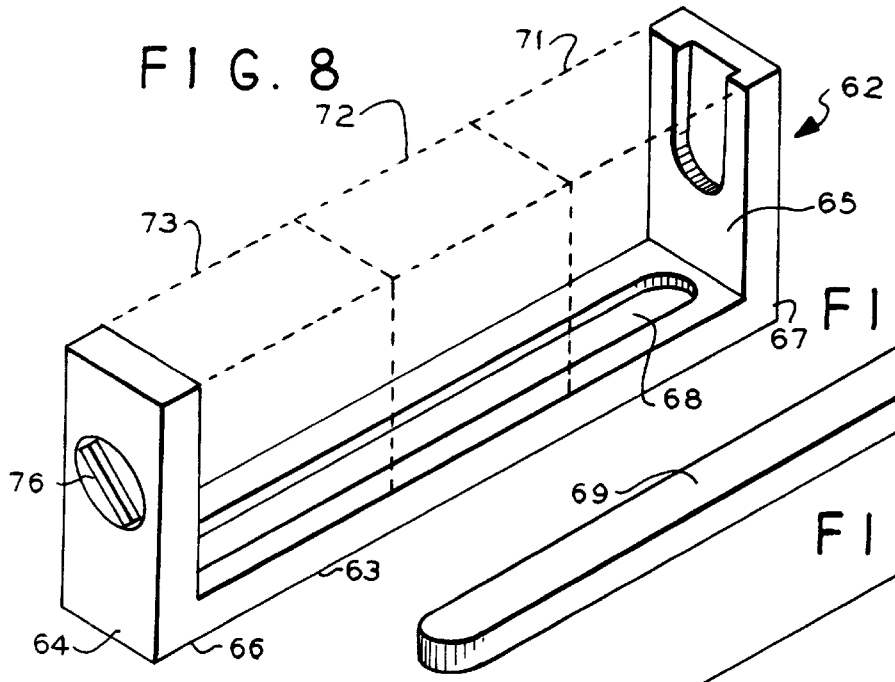
FIG. 8 is a second configuration for the container shown.

In place of utilizing the male and female tongue and groove mating system described above, a vertical groove with a corresponding vertical projection can be provided. FIG. 8 illustrates an elongated vertical tongue or channel type of connector. The tongue 50 fits into the corresponding recess 52. FIG. 6 shows a ball-bearing type of connection. The ball 40 is provided with a corresponding recess 42.

As indicated, the size of the unit will depend upon the material to be dispensed. A typical container unit will be approximately 4 inches in diameter with a height of about 2.25 inches with each dispenser being one-half of the height or about 1.125 inches.

Figure 5:
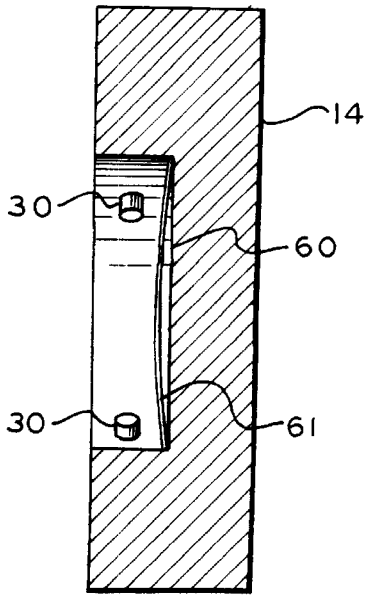
FIG. 5 is a side elevation showing the tongues and spring load for locking the dispensers in the containers.

Referring to FIG. 5, a spring-loaded surface 60, such as a flat metal spring steel strip 61, can be utilized in the base so the dispensers snap into place and hold the tongue securely in the groove.

Figure 9:
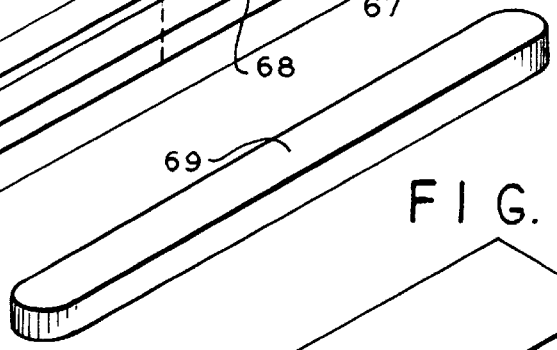
FIG. 9 is a plan view showing the key which fits in the groove shown in FIG. 8.
Figure 10:
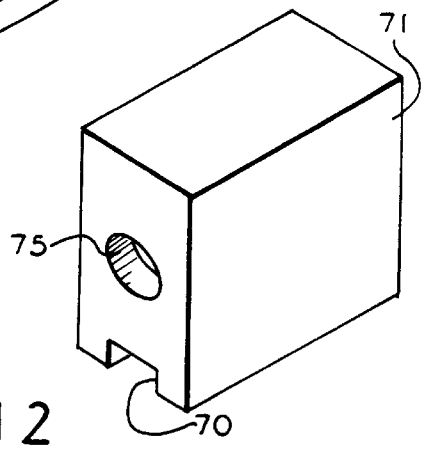
FIG. 10 is an end view of one of the containers utilized in the container shown in FIG. 8.
Figure 11:
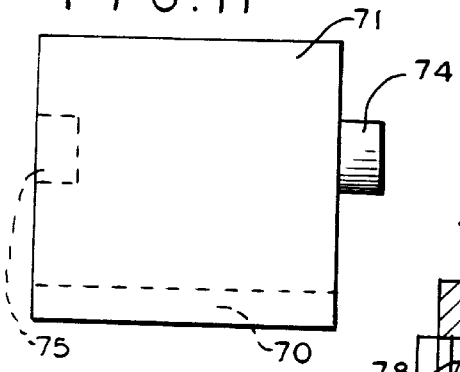
FIG. 11 is a side view of the container shown in FIG. 10.
Figure 12:
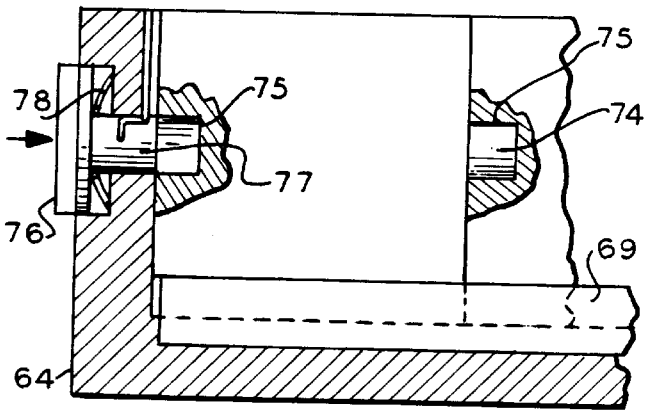
FIG. 12 is an elevation, partly in section, showing one end of the container shown in FIG. 8.
Figure 13:
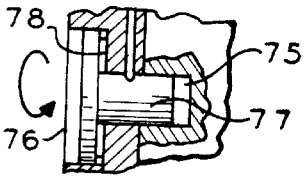
FIG. 13 is an elevation, partly in section, showing an alternate release mechanism.

Referring to FIGS. 8 to 13 a base 63 and two vertical sides 64, 65 extending from the base 63 from its opposite ends 66, 67 in a generally vertical direction. The base 63 has a keyway 68 extending along the base and open at the top. A key 69 is shown in FIG. 9 which fits in the keyway 68 in the base 63. The key has sufficient thickness to extend above the keyway to fit the slot 70 which extends along the base of each dispenser 71, 72, 73. The extent of the slot is illustrated in FIG. 11. Each dispenser 71, 72, 73 has a projection 74 which extends into a similar hole 75 on the opposite end of the dispenser or in a similar hole provided in the vertical side 65. The dispensers 71, 72, 73 are slid into alignment on the keyway 69 and fitted into a unit by the projections extending into the adjacent dispenser, with the first dispenser's projection extending into the vertical side 65 of the base. The dispensers are held in a secure position by the spring action of a knob 76 which extends through the opposite side 76 of the base 63 as seen in FIG. 12. The knob 76 at its extended end has a projection 77 which extends into the end of the dispenser 73. The knob 75 when rotated in one direction moves its extension 77 out of the dispenser 73 to allow removal of the three dispensers. The knob 76 when rotated in the opposite direction by means of spring 78 and locking tabs 79 and 79', locks the knob into a fixed position holding the dispensers securely in the base and together. The projections 74 are shown in the drawings as tubular extensions, but they can take any convenient shape with the holes corresponding to the shape selected. Preferably, the projections on the dispensers have the dual function of serving as the screw cap or similar cap on the dispenser to allow the contents of the dispenser to be discharged. In this illustration, the dispensers are each 1.25 inches in width, 1.125 inches in height and 0.75 inches in thickness.

While the invention has been described in its preferred embodiment, it is to be understood that the words which have been used are words of description rather than limitation and that changes may be made within the purview of the appended claims without departing from the true scope and spirit of the invention in its broader aspects.

What is claimed is:

1. A decorative package unit containing multiple dispensers for articles, liquids or flowable solids comprising a container, a series of interconnecting dispenser units forming a unitary structure in the container, the dispenser units removably affixed to the container and to each another to form the unitary structure, locking means for interconnecting each of the dispenser units to the container for firmly holding each dispenser unit.

2. The decorative package as defined in claim 1, wherein a spring-loaded means holds each dispenser unit in the unitary structure.

3. The decorative package as defined in claim 1, wherein the dispensers are interconnected by a tongue and groove locking means.

4. A decorative package containing multiple dispensers for articles, liquids or flowable solids comprising a container with a base and two vertical sides extending from the base at opposite ends of the base in a generally vertical direction, the base containing a keyway extending along the base, a key fitting into the keyway and extending above the keyway, a plurality of dispensers located between the two sides containing horizontal slots which allow the dispensers to slide on the portion of the key extending above the keyway, each dispenser provided on one side with an extending projection and on the opposite side with a mating hole for a similar projection, an extension on one of the vertical sides to mate with the hole on one side of one of the dispensers, a hole on the other vertical side to correspond with the projection on one of the dispensers, the dispensers being held in a secure position in parallel relationship by the spring action of a knob which extends through one of the sides of the base extending through the side to provide the projection for mating with a hole in one of the dispensers, the knob with locking means which when rotated in one direction moves its extension out of the mating hole in the dispenser, and when moved in the opposite direction operates the locking means to secure the dispensers in the base.

5. The decorative package containing multiple dispensers for articles, liquids or flowable solids as defined in claim 4 wherein the package contains three dispensers, each being 1.25 inches in width, 1.125 inches in height and 0.75 inches in thickness.

* * * * *